US006623681B1

(12) United States Patent
Taguchi et al.

(10) Patent No.: US 6,623,681 B1
(45) Date of Patent: Sep. 23, 2003

(54) POLYESTER FIBER AND PROCESS FOR PREPARING THE SAME

(75) Inventors: Setsuo Taguchi, Shiga (JP); Ryuji Ota, Shiga (JP); Satoru Shimoyama, Shiga (JP); Masumi Fujimoto, Shiga (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/424,162

(22) PCT Filed: May 20, 1998

(86) PCT No.: PCT/JP98/02215

§ 371 (c)(1),
(2), (4) Date: Nov. 19, 1999

(87) PCT Pub. No.: WO98/53126

PCT Pub. Date: Nov. 26, 1998

(30) Foreign Application Priority Data

May 20, 1997 (JP) ..... 9-129740

(51) Int. Cl.[7] ..... B29C 47/88

(52) U.S. Cl. ..... 264/211.15; 264/211.12; 264/211.14; 264/211.17; 264/211.2

(58) Field of Search ..... 428/364, 365, 428/85; 442/181, 304; 264/638, 639, 640, 176.1, 211.12, 211.14, 211.17, 211.2, 211.15

(56) References Cited

U.S. PATENT DOCUMENTS 4,690,866 A * 9/1987 Kumakawa et al. ..... 428/364

5,186,879 A * 2/1993 Simons et al. ..... 264/211.15

FOREIGN PATENT DOCUMENTS

| | | |
|---|---|---|
| EP | 0 753 395 A1 | 1/1997 |
| JP | 51 1-5476 A | 9/1976 |

* cited by examiner

*Primary Examiner*—Cheryl A. Juska
*Assistant Examiner*—Jenna Leigh Befumo
(74) *Attorney, Agent, or Firm*—Piper Rudnick LLP

(57) ABSTRACT

Intermediate polyester fibre and method for the production thereof, characterized in that highly oriented undrawn polyester yarn with a degree of crystallinity in a specified range is passed under a tension of $0.3\times10^{-2}$ g/d to $5.0\times10^{-2}$ g/d through a non-contact heater of heater temperature at least 250° C., and 5–40% shrinkage effected, giving the following properties (A):

(1) Specific gravity 1.335–1.360 (g/cm$^3$), (2) Degree of crystallinity 21–26%, (3) Crystal size in terms of Miller index (010) 1.4–2.2 nm, in terms of Miller index (100) 1.4–2.5 nm and in terms of Miller index (105) 1.6–3.5, (4) Degree of crystal orientation no more than 75% in the 010 plane and no more than 85% in the 105 plane, and (5) Degree of amorphous orientation 0.15–0.4, hot water shrinkage 0 to 35% and dry heat shrinkage 0–35%, and a method for the production of fabric or spatial fabric of outstanding resilience, which exhibits resistance to permanent yielding (resistance to pile damage or resistance to pile slanting, etc), together with bulkiness and cushioning properties.

3 Claims, 1 Drawing Sheet

POLYESTER FIBER AND PROCESS FOR PREPARING THE SAME

TECHNICAL FIELD

The present invention relates to intermediate polyester fibre of outstanding shaping properties, to highly elastic polyester fibre with outstanding resilience, shape retention and shaping properties, and to a method for the production thereof.

TECHNICAL BACKGROUND

A two-stage relaxation heat treatment of highly oriented undrawn polyester fibre is known from European Laid-Open Patent Application No. 753395. However, in this proposal, polyester highly oriented undrawn yarn with an extremely high heat shrinkage is used as it is so, as a result of the heat treatment, there is considerable shrinkage, and shrinkage unevenness, variations in weight, wrinkles and thickness yielding are produced. Furthermore, there is the problem of increased costs in that the shrink processing needs to be carried out slowly, dimensional change is considerable and the yield is considerably reduced.

On the other hand, there is also a method in which high orientation undrawn polyester fibre is subjected to a relaxation heat treatment using a non-contact heating means, and this fibre then combined with polyester multifilament drawn yarn using a yarn doubling or fibre blending means (Japanese Unexamined Patent Publication [Kokai] No. 8-158183).

However, the objective of this proposal is to subject highly oriented undrawn polyester fibre of a specified low degree of crystallization to a relaxation heat treatment to manifest self-stretchability and, in combination with drawn yarn, to confer a soft handle and suitable bulging. Moreover, the resilience and shape retention of the material with self-stretchability is extremely unsatisfactory.

On the other hand, fibre structures known as multilayer spacial fabrics, knitted spacer fabrics, three dimensional woven/knitted materials or three-dimensional fabrics, which comprise front and back ground structures, and a centre yarn (also known as the splicing yarn, pillar yarn or jointing yarn) connecting these together, have hitherto been used in many areas as a clothes backing material, a covering fabric for seating, linings for shoes, etc, because of their outstanding cushioning properties and heat insulation. For example, knitted spacer fabrics using a high-crimp yarn or fusion bonded yarn as the centre yarn (splicing yarn) or two-way tricot three-layer structure knitted materials employing Spandex monofilament as the centre yarn, are known but these are expensive since they employ polyurethane fibre.

Furthermore, with a structure composed of fibre alone, the resistance to permanent yielding and the cushioning properties are inadequate, so attempts have been made to laminate foamed polyurethane resin to the fibre structure, but this is a problem from the point of view of cost and it is also undesirable from the point of view of environmental considerations, in terms of waste treatment.

The objective of the present invention lies in offering polyester fibre where the low resilience and low recovery to repeated compression, which are the fatal defects of polyester fibre, are improved, and a method of producing fabric employing said fibre.

DISCLOSURE OF THE INVENTION

Polyester fibre of the present invention which meets this objective has following constitution.

Specifically, the present invention relates to an intermediate polyester fibre which is characterized by possessing the following properties (A):

Properties (A)

(1) Specific gravity 1.335–1.360 (g/cm$^3$), (2) Degree of crystallinity 21–26%, (3) Crystal size in terms of Miller index (010) 1.4–2.2 nm, in terms of Miller index (100) 1.4–2.5 nm and in terms of Miller index (105) 1.6–3.5 nm, (4) Degree of crystal orientation no more than 75% in the 010 plane and no more than 85% in the 105 plane, and (5) Degree of amorphous orientation 0.15–0.4, level of hot water shrinkage 0 to 35% and level of dry heat shrinkage 0–35%.

Furthermore, the present invention relates to a method of producing the intermediate polyester fibre which is characterized in that highly oriented undrawn polyester is passed under a tension of $0.3\times10^{-2}$ g/d to $5.0\times10^{-2}$ g/d through a non-contact heater at a heater temperature of at least 250° C., and 5 to 40% shrinkage effected, and also to a method of producing highly elastic polyester fibre which is characterized in that substantially without drawing this intermediate polyester fibre, and before and/or after producing fabric therefrom, a heat treatment is carried out at at least 120° C. to produce polyester fibre having the following properties (B):

Properties (B):

(1) Degree of crystallinity 22–30%, (2) Crystal size in terms of Miller index (010) 2.5–4.5 nm, in terms of Miller index (100) 2.5–4.5 nm and in terms of Miller index (105) 2.0–4.5 nm and, furthermore, the difference in crystal sizes between these Miller indices is no more than 1.0 nm, (3) Degree of crystal orientation 50–85% in the 010 plane and 30–80% in the 105 planes, (4) Degree of amorphous orientation 0.15–0.40, (5) Amorphous density 1.31–1.37 g/cm$^3$, (6) Amorphous density/degree of amorphous orientation at least 3.2, (7) Initial elongation at least 10%, and (8) Apparent Young's modulus no more than 140 kgf/mm$^2$.

Additionally, the present invention relates to fabric which is characterized in that there is used a highly elastic polyester fibre having the aforesaid properties (B) as the centre yarn or pile yarn.

Optimum Mode for Practising the Invention

Figure 1:
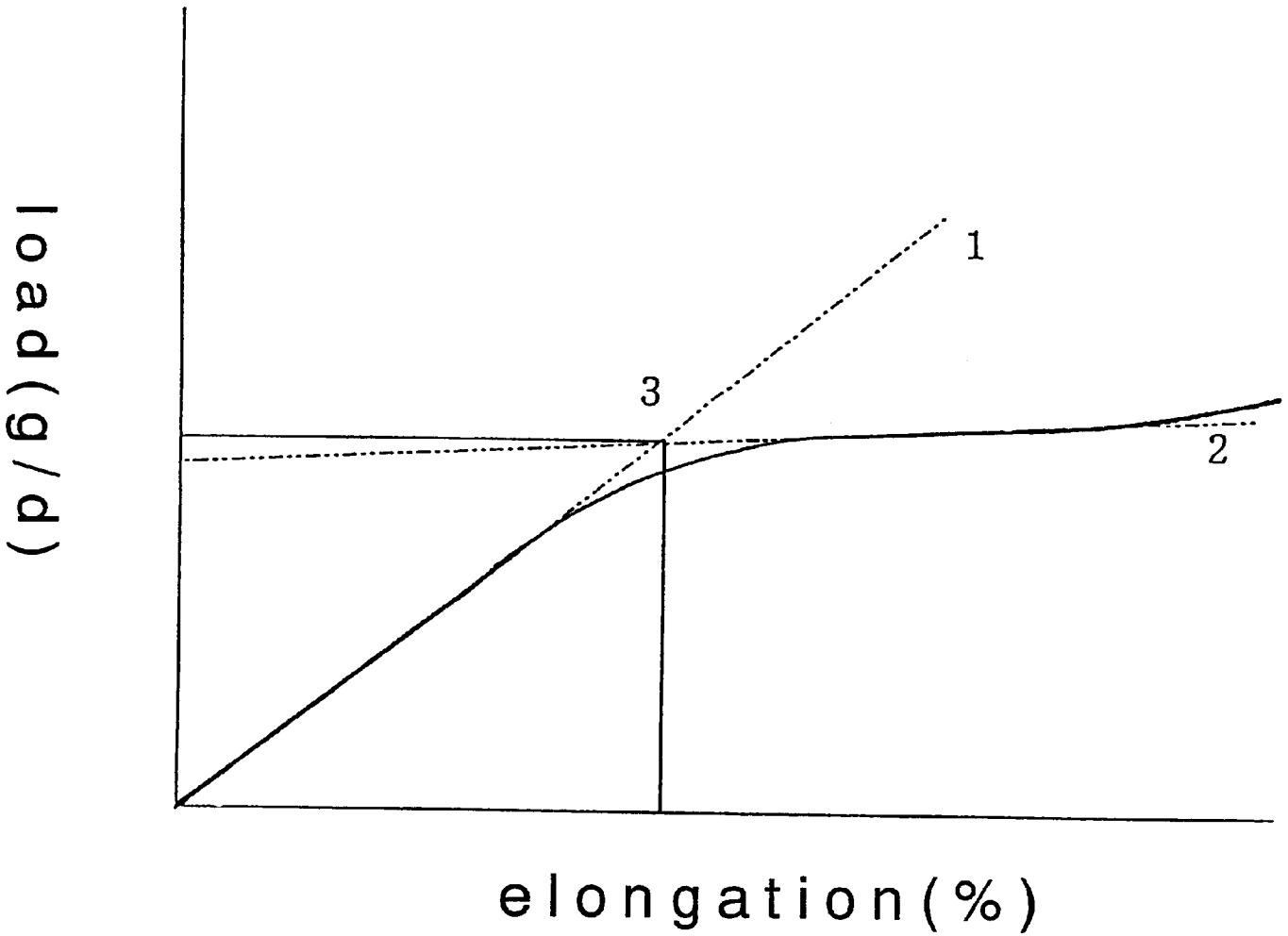
FIG. 1 is a graph showing the method of determining the initial stress and the initial elongation from the stress-strain (SS) curve obtained in a tensile test.

Below, the present invention is explained in detail.

The present invention relates to intermediate polyester of a unique structure which possesses the properties (A) discussed below, and by the high temperature heat treatment of this fibre, and fabric thereof, transformation takes place into a highly elastic polyester having the properties (B), and it is possible thereby to markedly improve the low resiliency and the low recovery to repeated compression (a tendency to show permanent yielding) which have been the problems of polyester fibre hitherto. Moreover, in the case of the high temperature treatment as a fabric, by a treatment in which the fabric is constrained to a desired shape, it is possible to produce a shaped fabric product having good shape durability and good resiliency.

The essence of the production method of the present invention is based on the concept of, on the one hand, relaxing the fibre axial direction strain to which it has been subjected in the spinning and, on the other, forming a stable crystalline/amorphous network structure having a high degree of freedom like that of a rubber, and the method comprises subjecting highly oriented undrawn polyester fibre having a comparatively high degree of crystallinity which lies in a specified range to a shrinkage treatment under strain to form, first of all, a precursor fibre or intermediate fibre for the manifestation of rubber elasticity (an intermediate polyester fibre which can be transformed by high temperature heat treatment to show the properties (B)), that is to say an intermediate polyester fibre with the properties (A).

Characteristics and Effects of Properties (A)

By heat-treating highly oriented undrawn polyester fibre having a degree of crystallinity lying in a specified range without drawing, and while effecting shrinkage under tension, the intermediate polyester fibre of the present invention, that is to say the polyester having the property values (A) is provided with a unique structure not possessed by any conventional undrawn yarn, semi-drawn yarn, drawn yarn or POY. In essence, it is an undrawn yarn but both its hot water shrinkage and dry heat shrinkage are low, at 0 to 35%, or again these may be further freely controlled to 0–10%. Furthermore, at 21–26%, the degree of crystallinity is higher than that of conventional relaxation heat-treated fibre, and the crystal size is extremely low when compared to conventional drawn yarn. The fibre is also characterised by an extremely low degree of crystal orientation and degree of amorphous orientation. Moreover, what is important is that the intermediate polyester fibre of the present invention can, by a subsequently-conducted high temperature heat treatment, undergo a change in structure and be transformed into highly elastic polyester possessing the property values (B). This highly elastic polyester fibre having the property values (B) is discussed in detail below, but it possesses rubber elasticity not to be seen in conventional polyester fibre and exhibits outstanding resilience and outstanding recovery in terms of repeated compression, which are extremely useful industrially.

In other words, the intermediate polyester fibre does not itself possess rubber elasticity but by subjecting it to a high temperature treatment it is converted to fibre having a structure possessing the properties (B), and rubber elasticity is manifested.

Method of Producing the Fibre Relating to the Present Invention

In the production method of the present invention, the intermediate polyester is obtained by passing highly oriented undrawn polyester fibre, which has been melt-spun at a take-off speed of 2000–4000 m/minute, and preferably 2500–3500 m/minute, of degree of crystallinity 21–26%, preferably 22–25%, and birefringence $20–80\times10^{-3}$, preferably $30–70\times10^{-3}$, through a non-contact type heater of heater temperature 2500° C. or above, preferably 300° C. or above, under a tension of $0.3\times10^{-2}$ g/d to $5.0\times10^{-2}$ g/d, at a processing speed of at least 300 m/minute and preferably at least 400 m/minute, and effecting 5 to 40%, preferably 10–35%, shrinkage. Here, the tension is the value measured at a position just after emerging from the heater. In the case of a number of heater zones, it is the tension in the yarn at a position just after emerging from the first heater. The heater temperature is the atmospheric temperature measured, with no yarn passing, by means of a temperature sensor fitted at a position within 1 cm of the route along which the yarn travels. The processing speed is the yarn speed at the driving means following the final heat treatment. As the polyester, there is employed polyethylene terephthalate or a copolymer chiefly comprising polyethylene terephthalate.

In forming the intermediate polyester fibre of property values (A), the important conditions are (1) the use of highly oriented undrawn polyester fibre of specified birefringence ($20–80\times10^{-3}$) and degree of crystallinity (21–26%), (2) in a high temperature non-contact heater at 250° C. or above, (3) at a processing speed of at least 300 m/minute, (4) under a specified state of tension (tension $0.3\times10^{-2}$ g/d to $5.0\times10^{-2}$ g/d), and (5) with from 5 to 40% shrinkage being effected.

In order to realize still further preferred properties, selection is made from one or more of the following conditions, (1) the highly oriented undrawn polyester fibre is subjected to a multistage shrinkage heat. treatment using a non-contact type heater with two or more heater zones, (2) the heat treatment is effected with a first heater temperature of at least 250° C. and with the second and subsequent heaters at at least 300° C., (3) the level of shrinkage and the yarn tension in the shrinkage treatment in the first heater will be greater than those in the shrinkage treatments in the second and subsequent heaters, (4) the yarn speed will be at least 300 m/minute and preferably at least 400 m/minute, and (5) in a multistage heat treatment using a number of heaters, cooling is performed to 80° C. or below and preferably 60° C. or below between the heaters.

Besides the above, it is possible to use the heat quantity coefficient (heater temperature (° C.)×treatment 30 time (sec) as a measure of the preferred processing conditions. Normally, the treatment is carried out at at least 40° C. sec, preferably at least 60° C. sec and in particular at least 70° C. sec. Here, the heat quantity coefficient is determined from the formula 'heater temperature (° C.)×heat treatment time (sec)' by determining the heat treatment time from the heater length and the average of the yarn speed at the driving means on the heater input side and the yarn speed at the driving means on the output side.

Furthermore, by combination of the processing conditions comprising heater temperature, level of shrinkage and processing rate and by the use of a plurality of heaters in the shrinkage heat-treatment processing under tension, it is possible to obtain the low hot water shrinkage and dry heat shrinkage property values (A) of 0 to 35%, or in the same way it is also possible to obtain the property values of 0 to 10%.

Transformation to Properties (B) by Heat Treatment

With regard to the above, the mechanism of action is not altogether clear, but we believe that the state comes about because the strain in the highly oriented undrawn polyester fibre produced at the time of spinning is relaxed while applying tensile loading, so that shrinkage takes place while a comparatively high degree of crystallinity is maintained. The necessity for carrying out the shrinkage under tension is clear from the fact that if highly oriented undrawn polyester fibre undergoes heat shrinkage freely, it becomes extremely brittle.

Consequently, in said heat-shrinkage treatment, the treatment temperature, processing speed, processing tension, level of shrinkage and amount of heat applied, etc, are extremely important requirements in the invention. Again, it is thought that it is possible thereby to confer the latent capacity to undergo transformation to a fibre structure with properties (B) by carrying out free or constrained crystallization in the subsequent heat treatment.

Prior to and/or after conversion to fabric, the intermediate polyester fibre obtained by the shrinkage heat-treatment processing under tension is subjected to a high temperature heat treatment at 120° C. or above, preferably at 140° C. or above and especially at 160° C. or above with dry heat and/or moist heat, and converted to the highly elastic polyester fibre with the properties (B) discussed below. In this way, it is possible to achieve rubber elasticity hitherto inconceivable in a polyester fibre, and it is possible to produce fabric with good resilience and good recovery from repeated compression. Moreover, by carrying out the heat treatment while constrained to a desired shape, it is possible to produce shaped fabric products with highly durable shape retention and good resilience.

Such properties are totally different from those obtained in the case of conventional methods where the objective is to realize self-stretchability by the relaxation heat treatment of highly oriented undrawn polyester fibre of low degree of crystallinity.

Characteristics and Effects of Properties (B)

As stated above, by high temperature heat treatment of the intermediate polyester fibre it is possible to effect transformation into a highly elastic polyester fibre with the properties (B). The characteristics thereof are (1) a degree of crystallinity, at 22–30%, and preferably 24–28%, about the same as that of conventional polyester drawn fibre, (2) an isotropic crystal size, that is to say 2.5–4.5 nm for Miller index 010, 2.5–4.5 for Miller index 100, and 2.0–4.5 nm for Miller index 105, and the difference between the crystal sizes for the respective Miller indices is no more than 1.0 nm and preferably no more than 0.7 nm, (3) a low degree of amorphous orientation, namely 0.15–0.40 and preferably 0.20–0.32, (4) a high amorphous density, namely 1.31–1.37 g/cm$^3$ and preferably 1.34–1.37 g/cm$^3$, and (5) in particular, the value of the amorphous density/degree of amorphous orientation is extremely high, being at least 3.2 and preferably at least 4.0. As the mechanism of the manifestation of rubber elasticity, it is assumed that there is formed a network structure which is fully relaxed, of a high degree of freedom and which has high density amorphous regions constrained by isotropic crystalline regions. In terms of function, the fibre possesses rubber elasticity inconceivable in a polyester fibre, that is to say the fibre characteristics based on the properties obtained from the load-extension curve, which are shown in the following table, comprise a high value of initial elongation of at least 10% and preferably at least 15%, a low value of initial stress of no more than 1.5 g/d, and a low value of Young's modulus of no more than 140 kgf/mm$^2$ and preferably no more than 100 kgf/mm$^2$. The values indicate that good resiliency, shape retention (dimensional stability) and flexibility are shown, and in particular in the case of thick or high pile fabrics there are exhibited cushioning properties with a good handle and outstandingly high recovery from repeated compression. Furthermore, the characteristics in the following table clearly show that as a result of the high temperature heat treatment of fibre (i) or (ii) which lie in the range of property values (A), there is transformation to fibre (iii), (iv) or (v) which possess property values (B).

| | Initial Stress (g/d) | Initial Elongation (%) | Young's Modulus (kgf/mm$^2$) | NS (%) | KS (%) |
|---|---|---|---|---|---|
| Fibre with properties (i) | 0.57 | 4 | 173 | 8 | 5 |
| Fibre with properties (ii) | 0.56 | 4 | 170 | 21 | 24 |
| Fibre with properties (iii) | 0.56 | 22 | 32 | 1 | 0 |
| Fibre with properties (iv) | 0.59 | 18 | 41 | 1 | 0 |
| Fibre with properties (v) | 0.56 | 35 | 20 | 0 | 1 |
| Conventional drawn yarn | 3.00 | 8 | 460 | 8 | 10 |
| Conventional POY | 0.72 | 5 | 173 | 45 | 68 |

Here, fibres (i) and (ii) were obtained by subjecting 255 denier 30 filament POY (the conventional POY referred to in the table above) of birefringence 0.04 and degree of crystallinity 25%, produced by the melt spinning of polyethylene terephthalate (IV=0.68) at a take-off rate of 3100 m/minute, to either two-stage 25% (i) or 35% (ii) shrinkage under a tension of $2.1\times10^{-2}$ g/d. Fibre (iii) was obtained by the dry heat treatment of fibre (i) for 3 minutes at 180° C. in the free state, and fibre (iv) was obtained by dry heat treatment of fibre with property values (i) for 3 minutes at 180° C. with heat setting taking place in a 3% relaxed state. Fibre (v) was obtained by the dry heat treatment of fibre (ii) in the free state for 3 minutes at 180° C. The conventional drawn yarn was an ordinary 150 denier 48 filament product. The initial stress, initial elongation and the Young's modulus were the values measured by the following methods.

NS indicates the level of hot water shrinkage and KS the level of dry heat shrinkage, the methods of measurement being as follows.

Tensile strength: This was based on JIS-L 1013.

Initial stress, initial elongation: As shown in FIG. 1, the initial stress and initial elongation were taken from the point of intersection of the first and second tangents drawn on the stress-strain curve obtained in a tensile test.

Apparent Young's modulus, hot water shrinkage and dry heat shrinkage: These were based on JIS-L 1013.

Forms of Application of the Fibre Relating to the Invention

While it is a requirement of the present invention that it be intermediate polyester fibre with properties (A), there may also be used a multi-constituent fibre formed by combination of some other component with this fibre component, for example the polyester plus nylon or polyolefin, etc. In such circumstances, there may also be employed splittable fibre, chrysanthemum-type fibre, 'islands-in-a-sea' type fibre or the like, and depending on the application this may be preferred.

With regard to the yarn form, the objectives of the invention are favourably realized with flat yarn, but there can also be used air-interlaced yarn or false-twist textured yarn.

The thickness of the polyester fibre employed in the present invention is not particularly restricted but, in general, there is preferably employed fibre of individual fineness 1 to 200 denier, in the form of yarn of total denier from 20 to 1000.

Again, from the point of view of obtaining high strength, high modulus and shrink resistance, the intrinsic viscosity of the polyester (o-chlorophenol, 30° C.) is preferably from 0.55 to 1.00. Moreover, from the point of view of facilitating dyeing, the polyester may be a copolymer of polyalkylene glycol with the polyethylene terephthalate, to give a-product which can be disperse-dyed at 90–110° C. In the case of polyester fibre which employs such polyester, there are advantages in terms of dyeing when mixed with natural fibre. Furthermore, from the point of view of carrying out deep vivid dyeing, there can be employed a cationic dyestuff-dyeable type polyester obtained by the copolymerization of 5-sodiumsulphoisophthalic acid in the polyester.

The polyester fibre of the present invention can optionally be mixed with other fibre. The polyester fibre of the present invention is substantially an undrawn yarn but its hot water shrinkage or dry heat shrinkage can be freely controlled to 0–35%, and so mixing with other fibre is easy and the application range is extremely broad. For example, a preferred embodiment is mixing with one or more type of fibre selected from polyester fibre outside the scope of the present invention, polyamide fibre, polyacrylic fibre, aramid fibre, polyurethane fibre, wool, cotton, silk, rayon or flax.

In order that the effects of the present invention be markedly apparent, the amount of the mixed polyester fibre of the present invention is preferably at least 30%, more preferably at least 50% and still more preferably at least 75%. Of course, employing just the polyester fibre of the present invention is a preferred embodiment.

Application Forms as a Fabric

With regard to the fabric used in the present invention, application is possible to woven fabrics, knitted fabrics, nonwoven materials and other conventionally-known fibre sheets, and there are no particular restrictions thereon.

As fabric forms where the properties of the polyester fibre of the present invention are more effectively apparent, there are combination fabric, pile fabric and leno fabric structures themselves or fabric structures in which these are applied. Specifically, by employing the polyester fibre of the present invention in thick materials, raised pile and bulky fabrics, it is possible to manifest exceptional performance such as resilience, shape retention (dimensional stability), cushioning properties, recovery from repeated compression, flexibility, and resistance to pile damage, etc.

Here, a combination structure is a fabric structure in which there are used two or more types of yarn either as the warp or as the weft, or alternatively as both. Such a material is thick, firm, heavy and has good thermal insulation, and it is employed when producing a material both faces of which are used. A pile structure is a fabric where the ground structure is covered at one or both faces with a fuzz or with loops, that is to say a pile. A leno structure is one in which adjacent warp yarns are entwined so that a porous fabric can by produced.

Specific examples of such structures to which the fibre is preferably applied are jersey materials, in particular double jersey materials, double raschel materials, moquette materials or knitted spacer fabrics, etc. Furthermore, as pile fabrics, the fibre is preferably applied to velveteen, corduroy, towel fabric, broad cloth, and the like.

Application as Knitted Spacer Fabric

Now, specific explanation is provided of an example of the fabric normally known as a knitted spacer fabric which is a fibre sheet structure where bulkiness is provided in the thickness direction by the support of a centre yarn and permanent yielding prevented, and where the properties of the present invention can be manifested still further. A knitted spacer fabric is a multilayer fabric, spatial fabric or pile fabric where front and back ground structures are connected using a centre yarn (also referred to as the pillar yarn, splicing yarn or jointing yarn). By employing the polyester fibre of the present invention as the centre yarn or pile, it is possible to realize cushioning properties with a good handle and with recovery from repeated compression (resistance to thickness direction yielding), and also to achieve a marked improvement in terms of pile damage which has been a problem with conventional polyester.

Other names for a knitted spacer fabric are a multilayer spatial fabric, or a three-dimensional woven/knitted material or three-dimensional fabric, etc. It comprises a woven multilayer structure, or a rubber knitted structure or double-faced knitted structure produced using a double knitting machine, and its production means is not restricted.

The central fibre may be the polyester fibre of the present invention by itself, and it is preferred that there be used thick fibre of single fibre denier at least and more preferably at least 8.

Again, when mixing with other fibre, for the purposes of further increasing the resilience there is preferably used a twisted union yarn in which, as the fibre other than the polyester fibre of the present invention, there is employed a thick drawn yarn of single fibre denier at least 5 denier and preferably at least 8 denier. A twisted union yarn based on monofilament is also a preferred embodiment.

The fibre employed for the front and back ground structures of the knitted spacer fabric of the present invention is not particularly restricted. That is to say, there can be employed generally-used synthetic fibres such as polyester, nylon, acrylic, polypropylene, polyethylene or other such filament or staple yarn. Of these, a false-twist textured yarn with stretchability is preferred. Again, there can also be employed natural fibres such as wool, cotton, flax or the like. Moreover, combination yarns thereof (twist union yarn, doubled yarn, long/short staple composite yarn, etc) can also be used with advantage.

Of course, the front or back ground structures are not necessarily restricted just to the front or back layers of a fabric, and the fabric may have sheets employed in inner layers of the fabric connected by a centre yarn. Furthermore, such sheets are not restricted to just two layers and the material may be a multilayer fibre sheet with three or more layers.

A knitted spacer fabric where polyester fibre of the present invention is used as the centre yarn is outstanding in its cushioning properties and recovery from repeated compression and so can be used advantageously as a vehicle seat covering fabric or furniture upholstery. Since the resistance to yielding, bulkiness and cushioning have hitherto been inadequate in such applications, there has often been employed the affixing or lamination of a polyurethane foam or the like to improve performance. However, when the fibre of the present invention is used, it is possible to achieve the required performance using the fibre alone, so cost reduction is possible and there are also the considerable advantages of the fabric being air and water permeable, and being clean, without the environmental problems associated with the disposal of polyurethane foam.

Furthermore, subjecting the fabric obtained in the present invention to various types of finishing, such as dyeing, water-repellency processing, lamination or coating, is still more effective and is preferred.

Other Applications

Due to their capacity to mitigate stress concentrations based on their rubber elasticity, further properties of the fibre and of the fabric of the present invention are (1) a high tear strength, (2) good impact absorption properties and (3) resistance to pilling.

As explained above, the polyester fibre of the present invention has many useful properties, and can be employed in the form of various fabric structures and shapes, or on its own or mixed with other fibre, and so its application range is broad.

Applications include use as a general clothing material and also, making use of the resilience, cushioning and compression recovery properties, as vehicle seat covering materials such as car seat covering materials, vehicle interior trim materials, furniture upholstery materials, shoe lining materials (including upper and bottom materials), shoe insoles and the like; making use of the impact absorption and pilling resistance properties, as warm-up suits and other types of sports wear materials, nursing and medical uniform materials and the like; making use of the high tear strength, as paraglider materials, hang glider materials, yacht sail cloth and the like; and making use of the shaping properties, as a hat material, cup material such as a brassiere cup or swimsuit cup, shoulder pad or the like.

Methods of Analysis

Below, explanation is given of some examples, but first of all the methods of analysis referred to in this specification are explained.

The methods and conditions of measurement of the various properties were as follows.

(1) Specific Gravity:

This was based on the density gradient column method in 7.14.2 of JIS-L 1013.

(2) Degree of Crystallinity:

This was measured by wide angle X-ray diffraction (diffractometer method) as follows, based on the method of W. ruland (W. Ruland, Acta Cryst., 14 (1961), 1180–1185)

| | |
|---|---|
| X-ray generator; | made by Rigaku Denkisha K.K.<br>X-ray source: CuKα radiation (Ni filter)<br>curved crystal monochrometer (using graphite)<br>output: 50 KV 200 mA |
| Goniometer; | made by Rigaku Denkisha K.K.<br>slit diameter: 1°–0.15 mm-1°<br>detector: scintillation counter |
| Counting recorder; | RAD-B, made by Rigaku Denkisha K.K. |
| Scanning system; | 2θ/θ continuous scan<br>measurement range: 2θ = 5 to 140°<br>sampling: 0.02°<br>scanning rate: 3° per minute |

(3) Measurement of crystal size by wide angle X-ray diffraction (a) Wide angle X-ray diffraction (counter method)

| | |
|---|---|
| X-ray generator; | made by Rigaku Denkisha K.K.<br>X-ray source: CuKα radiation (Ni filter)<br>output: 35 KV 15 mA |
| Goniometer; | made by Rigaku Denkisha K.K.<br>slit diameter: 2 mm diameter pinhole collimator<br>detector: scintillation counter |
| Counting recorder; | RAD-C, on-line data processing system |
| | scanning range in equatorial direction<br>10 to 35°<br>scanning range in meridional direction<br>30 to 55°<br>scanning method<br>step: 2θ/θ<br>sampling intervals: 0.05°/step<br>integrating time: 2 seconds<br>circumferential direction (β) scan<br>range: 90–270°<br>sampling interval: 0.5°/step<br>integrating time: 2 seconds |

(b) Wide angle plate photography

| | |
|---|---|
| X-ray generator: | made by Rigaku Denkisha K.K.: model 4036A2<br>X-ray source: CuKα radiation (Ni filter)<br>output: 35 KV 15 mA<br>slit diameter: 1 mm diameter, pinhole collimator |
| Photographic conditions | camera radius: 40 mm<br>exposure time: 20 minutes<br>film: Kodak DEF-5 |

The crystal size was calculated from the half-widths of the peaks corresponding to Miller indices (010), (100) and (105) using the Scherrer formula as follows.

$$L(hkl)=K\lambda/\beta_0 \cos \theta_B$$

where

L(hkl): average size in the direction perpendicular to the crystallite (hkl) plane K: 1.0, λ: X-ray wavelength, $\beta_0=(\beta_{E2}-\beta_{12})^{1/2}$ $\beta_E$: apparent half width (measured value)

$\beta_1$: $1.05\times10^{-2}$ rad., $\theta_B$: Bragg angle (4) Degree of Crystal Orientation by Wide-angle X-ray Diffraction Measurement This was calculated using the following formula from the half-width H of the intensity distribution obtained by scanning each peak in the circumferential direction.

$$\text{Degree of crystal orientation (\%)} = [(180 - H)/180]\times 100$$

(5) Degree of Amorphous Orientation by the Polarized Fluorescent Light Method

Instrument: FOM-1, made by Nihon Bunko Kogyo

Optical system: transmission method (excitation wavelength 365 nm, fluorescence wavelength 420 nm)

Measurement system: by rotation with polarizer ‖ analyser, and polarizer=analyser, the angular distribution of the polarized fluorescent intensities (‖,⊥) in the plane were obtained.

Here, ‖ denotes parallel and ⊥ denotes perpendicular).

The degree of amorphous orientation was determined from the following formula as the uniaxial orientation coefficient $f^2$.

$$f^2=3/2[\{\|(0)+2\perp(0)\}/K-1/3]$$

Where

‖ (0): relative polarized fluorescent intensity in axial direction by ‖ measurement ‖ (90): relative polarized fluorescent intensity in the direction perpendicular to the above by ‖ measurement ⊥ (0): relative polarized fluorescent intensity in axial direction by ⊥ measurement (6) Amorphous Density The amorphous density (da) was determined from the following formula $$da(\mathrm{g/cm^3})=[d-dc\times\{(Xc/100)/dc\}\times d]/[1-\{Xc/100)/dc\}\times d]$$

d: fibre density (g/cm$^3$)

dc: 1.501

Xc: degree of crystallinity (%)

Now, the fibre density was measured by the density gradient column method in 7.14.2 of JIS-L1013.

(7) Birefringence

This was measured by the Senarmont method using sodium D light.

EXAMPLES

Examples 1 and 2, Comparative Examples 1 to 4

255 denier 30 filament POY was obtained by melt spinning polyethylene terephthalate (IV=0.68) and employing a take-off rate of 3100 m/minute. Without drawing, this raw yarn was treated by passage under a tension of $1.5\times10^{-2}$ g/d and at a rate of 350 m/minute through a 350° C. atmosphere in a non-contact heater (length 2 m) and 25% shrinkage effected, and 320 denier shrink-treated yarn obtained (Example 1). As a further set of treatment conditions, there was used a yarn processor with two independent non-contact heaters and, at a processing rate of 400 m/minute, 340 denier shrink-treated yarn (Example 2) was obtained by effecting 20% shrinkage at a first stage heater temperature of 320° C., a heater length of 2 m and a tension of $1.8\times10^{-2}$ g/d, and then effecting 10% shrinkage with the temperature of the second stage heater at 320° C., at a heater length of 1 m and a tension of $0.7\times10^{-2}$ g/d, to give a total shrinkage of 30%.

The properties of the shrink-treated yarns in Examples 1 and 2 were as follows, and both satisfied the property values (A) which are a necessary condition in the present invention.

| | Example 1 | Example 2 |
|---|---|---|
| 1) Specific gravity (g/cm$^3$) | 1.341 | 1.348 |
| 2) Degree of crystallinity (%) | 22 | 23 |
| 3) Crystal size (nm) | | |
| Miller index (010) | 1.7 | 1.9 |
| Miller index (100) | 1.6 | 1.7 |
| Miller index (105) | 2.7 | 2.9 |
| 4) Degree of crystal orientation (%) | | |
| Miller index (010) | 53 | 51 |
| Miller index (105) | 72 | 78 |
| 5) Degree of amorphous orientation | 0.22 | 0.20 |
| 5) Hot water shrinkage (%) | 6 | 5 |
| 6) Dry heat shrinkage (%) | 8 | 6 |

A plain-weave fabric was woven using this shrink-treated yarn as the warp and weft yarn, and then the fabric was heat-treated in a hot forced-air dryer for 3 minutes at 180° C. In this treatment, the warp shrunk about 3% and the weft about 4%. Next, dyeing was carried out using disperse dye,for 20 minutes at 130° C. The resilience of the woven fabric obtained was good both in the case of Example 1 and Example 2, and the fabric possessed the property of springing back to its original sheet shape when squeezed with the hand and then released, and so it had a strong sense of 'springiness'. Of the two, the resilience of Example 2 was slightly higher.

The property values determined by analysis of yarn removed from the dyed fabric in Examples 1 and 2 were as follows, and in both cases the properties lay within the range of property values (B) which are a necessary condition of the present invention.

| | Example 1 | Example 2 |
|---|---|---|
| 1) Degree of crystallinity (%) | 23 | 24 |
| 2) Crystal size (nm) | | |
| Miller index (010) | 3.1 | 3.5 |
| Miller index (100) | 3.5 | 3.4 |
| Miller index (105) | 3.2 | 2.8 |
| Difference in crystal size between Miller indices | 0.4 | 0.7 |
| 3) Degree of crystal orientation (%) | | |
| Miller index (010) | 75 | 63 |
| Miller index (105) | 68 | 41 |
| 4) Degree of amorphous orientation | 0.26 | 0.26 |
| 5) Amorphous density (g/cm$^3$) | 1.35 | 1.35 |
| 6) Amorphous density/deg. of amorphous orientation | 5.2 | 5.2 |
| 7) Initial elongation (%) | 18 | 22 |
| 8) Apparent Young's modulus | 41 | 32 |

As comparative examples, the aforesaid POY was employed and drawing carried out 1.3 times at room temperature (Comparative Example 1) or 1.7 times at 280° C. (Comparative Example 2). Furthermore, using the aforesaid POY, no drawing was carried out and a 50% shrinkage treatment effected by passing through a 350° C. atmosphere in a non-contact heater (length 2 m) at a rate of 400 m/minute under a tension not exceeding $0.1\times10^{-2}$ g/d (Comparative Example 3). Again, a 20% shrinkage treatment was effected by passage through a 180° C. atmosphere in a non-contact heater (length 2 m) at a rate of 400 m/minute under a tension not exceeding $1.5\times10^{-2}$ g/d (Comparative Example 4).

The properties of these yarns were as follows, but none of these four types of yarn satisfied the property values (A) which are a necessary condition in the present invention.

| | Comp. Example 1 | Comp. Example 2 | Comp. Example 3 | Comp. Example 4 |
|---|---|---|---|---|
| 1) Specific gravity (g/cm$^3$) | 1.355 | 1.362 | 1.350 | 1.341 |
| 2) Degree of crystallinity (%) | 25 | 27 | 18 | 17 |
| 3) Crystal size (nm) | | | | |
| Miller index (010) | 2.1 | 2.3 | 1.8 | 1.4 |
| Miller index (100) | 2.2 | 2.3 | 1.6 | 1.4 |
| Miller index (105) | 3.7 | 4.1 | 1.4 | 1.6 |
| 4) Degree of crystal orientation (%) | | | | |
| Miller index (010) | 83 | 87 | 53 | 60 |
| Miller index (105) | 83 | 87 | 71 | 65 |
| 5) Degree of amorphous orientation | 0.51 | 0.55 | 0.11 | 0.24 |
| 6) Hot water shrinkage (%) | 11 | 9 | 13 | ≧40 |
| 7) Dry heat shrinkage (%) | 13 | 10 | 15 | ≧40 |

Plain-weave fabrics were woven in the same way as in Example 1 and Example 2 using these four types of yarn, and then heat treatment and dyeing carried out in the same way. The fabrics obtained all lacked resilience, and when squeezed with the hand and then released numerous creases were produced and the fabrics did not recover their original shape. The property values determined by analysis of yarn removed from the dyed fabrics in Comparative Examples 1 to 4 were as follows, and they did not satisfy the properties (B) of the present invention.

| | Comp. Example 1 | Comp. Example 2 | Comp. Example 3 | Comp. Example 4 |
|---|---|---|---|---|
| 1) Degree of crystallinity (%) | 26 | 28 | 19 | 17 |
| 2) Crystal size (nm) | | | | |
| Miller index (010) | 4.0 | 4.3 | 3.3 | 2.4 |
| Miller index (100) | 3.3 | 3.6 | 2.8 | 2.8 |
| Miller index (105) | 4.6 | 4.8 | 2.5 | 2.4 |
| Difference in crystal size between Miller indices | 1.3 | 1.2 | 0.8 | 0.4 |
| 3) Degree of crystal orientation (%) | | | | |
| Miller index (010) | 86 | 90 | 59 | 58 |
| Miller index (105) | 86 | 90 | 75 | 76 |
| 4) Degree of amorphous orientation | 0.50 | 0.52 | 0.12 | 0.13 |
| 5) Amorphous density (g/cm$^3$) | 1.31 | 1.31 | 1.34 | 1.35 |
| 6) Amorphous density/deg. of amorphous orientation | 2.6 | 2.5 | 11.2 | 10.4 |
| 7) Initial elongation (%) | 7 | 8 | 48 | 56 |
| 8) Apparent Young's modulus | 380 | 460 | could not be measured | could not be measured |

Example 3, Comparative Examples 5 and 6

255 denier 30 filament POY was obtained by melt spinning polyethylene terephthalate (IV=0.68) and employing a take-off rate of 3100 m/minute. Without drawing, this raw yarn was treated by passage at a processing speed of 420 m/minute through a first heater (heater length 2 m) under a tension of $1.8\times10^{-2}$ g/d and 20% shrinkage effected at a temperature of 350° C., and through a second heater (heater length 2 m) under a tension of 0.7×10−2 g/d and 10% shrinkage effected at a temperature of 20 450° C., to give a total shrinkage of 30% (Example 3). As comparative examples, a 280 denier 14 filament drawn yarn (Comparative Example 5) and a 300 denier 72 filament false-twist textured yarn (Comparative Example 6) were prepared.

The properties of these were as follows. Example 3 satisfied the range of property values (A) stipulated in the present invention, while Comparative Examples 5 and 6 lay outside of the range.

| | Example 3 | Comp. Example 5 | Comp. Example 6 |
|---|---|---|---|
| 1) Specific gravity (g/cm$^3$) | 1.346 | 1.355 | 1.362 |
| 2) Degree of crystallinity (%) | 23 | 28 | 29 |
| 3) Crystal size (nm) | | | |
| Miller index (010) | 1.7 | 2.4 | 2.2 |
| Miller index (100) | 1.7 | 2.5 | 2.5 |
| Miller index (105) | 2.6 | 4.1 | 4.1 |

-continued

| | Example 3 | Comp. Example 5 | Comp. Example 6 |
|---|---|---|---|
| 4) Degree of crystal orientation (%) | | | |
| Miller index (010) | 55 | 88 | 86 |
| Miller index (105) | 73 | 87 | 87 |
| 5) Degree of amorphous orientation | 0.20 | 0.55 | 0.55 |
| 6) Hot water shrinkage (%) | 5 | 5 | 9 |
| 7) Dry heat shrinkage (%) | 6 | 6 | 10 |

Using these three types of yarn as the centre yarn, and with 150 denier 48 filament false-twist textured yarn forming the front and back ground structures, a knitted spacer fabric grey cloth was produced using double-face circular knitting machine, and then treatment carried out for 3 minutes at 180° C. without widthwise stretch by passage through a net conveyor type heat treatment machine. Next, dyeing was carried out for 45 minutes at 130° C. using disperse dyestuff.

The knitted spacer fabric obtained in Example 3 did not readily exhibit permanent yielding in terms of repeated compression loading, and the sheet as a whole possessed good resilience and good cushioning properties. In contrast, those in Comparative Examples 5 and 6 readily showed permanent yielding, and had poor resilience and cushioning properties.

The test results for the compression recovery characteristics in Example 3 and in Comparative Examples 5 and 6 were as follows.

| Item | Example 3 | Comp. Example 5 | Comp. Example 6 |
|---|---|---|---|
| recovery following compression 30 times (%) | 95 | 79 | 77 |
| level of permanent yielding following compression treatment (200 g/cm$^2$ × 10 days) (%) | 8 | 16 | 14 |

Note: Measurement conditions
1) percentage recovery following 30 compressions at a compression factor of 50%
2) percentage permanent yielding after applying a compression load of 200 g/cm$^2$ × 10 days, then removing the load and leaving for 24 hours The property values analysed after removing centre yarn from the three types of knitted spacer fabrics were as follows. Example 3 satisfied the property values (B) which are a necessary condition of the present invention. On the other hand, Comparative Examples 5 and 6 did not satisfy said property values (B) which are a necessary condition of the present invention.

| | Example 3 | Comparative Example 5 | Comparative Example 6 |
|---|---|---|---|
| 1) Degree of crystallinity (%) | 24 | 28 | 29 |
| 2) Crystal size (nm) | | | |
| Miller index (010) | 3.7 | 4.3 | 4.1 |
| Miller index (100) | 3.4 | 3.7 | 3.6 |
| Miller index (105) | 3.0 | 4.9 | 4.7 |
| Difference in crystal size between Miller indices | 0.7 | 1.2 | 1.1 |

-continued

| | Example 3 | Comparative Example 5 | Comparative Example 6 |
|---|---|---|---|
| 3) Degree of crystal orientation (%) | | | |
| Miller index (010) | 63 | 90 | 89 |
| Miller index (105) | 41 | 89 | 88 |
| 4) Degree of amorphous orientation | 0.26 | 0.51 | 0.50 |
| 5) Amorphous density (g/cm$^3$) | 1.35 | 1.30 | 1.30 |
| 6) Amorphous density/deg. of amorphous orientation | 5.2 | 2.5 | 2.6 |
| 7) Initial elongation (%) | 20 | 8 | 7 |
| 8) Apparent Young's modulus | 36 | 453 | 432 |

Example 4

Using theshrunk yarn from Example 3, twisting (plying) was performed with a 280 denier 14 filament drawn yarn at 200 T/M (S twist). With this yarn as the centre yarn, and 150 denier 48 filament false-twist textured yarn as the yarn for the front and back ground structures, a knitted spacer fabric was produced using a double-face circular knitting machine. This knitted spacer fabric as treated for 5 minutes at 180° C. in a hot forced-air dryer, and then dyed for 30 minutes at 130° C. using disperse dye.

In the same way as in Example 3, the fabric obtained did not readily exhibit permanent yielding in terms of repeated compression loading, and the sheet as a whole had good resilience and showed good cushioning properties.

When the shrunk yarn portion of the central yarn was analysed after removal from the knitted material in Example 4, it satisfied the property values (B) which are a necessary condition in the present invention.

| | Example 4 |
|---|---|
| 1) Degree of crystallinity (%) | 24 |
| 2) Crystal size (nm) | |
| Miller index (010) | 3.3 |
| Miller index (100) | 3.4 |
| Miller index (105) | 3.2 |
| difference in crystal size between Miller indices | 0.2 |
| 3) Degree of crystal orientation (%) | |
| Miller index (010) | 75 |
| Miller index (105) | 55 |
| 4) Degree of amorphous orientation | 0.29 |
| 5) Amorphous density (g/cm$^3$) | 1.33 |
| 6) Amorphous density/degree of amorphous orientation | 4.6 |
| 7) Initial elongation (%) | 17 |
| 8) Apparent Young's modulus | 40 |

Examples 5 and 6, Comparative Examples 7 and 8

Using the knitted spacer fabric grey cloths from Examples 3 and 4, and from Comparative Examples 5 and 6, shaping was carried out for 1 minute at 180° C. using a hemispherical moulding machine. The products were respectively taken as Example 5 (using the grey cloth from Example 3), Example 6 (using the grey cloth from Example 4), Comparative Example 7 (using the grey cloth from Comparative Example 5) and Comparative Example 8 (using the grey cloth from Comparative Example 6). The shaping property, shape retention, resilience and washing durability were as follows. For each assessed item, the products of the present invention were better than the comparative examples.

| | Shaping Property | Shape Retention | Resilience | Washing Durability |
|---|---|---|---|---|
| Example 5 | ○ | ○ | ◎ | ○ |
| Example 6 | ○ | ◎ | ◎ | ○ |
| Comparative Example 7 | x | x | x | x |
| Comparative Example 8 | x | x | x | x |

Shaping property; assessed from the shape following moulding to a hemispherical shape
Shape retention; assessed after strongly squeezing with the hand
Resilience; assessed from the recovery after strongly squeezing with the hand
Washing durability; assessed from the resistance to shape loss after washing Now, the properties of the yarn removed from the shaped articles obtained in Example 5, Example 6, Comparative Example 7 and Comparative Example 8 were as follows. Example 5 and Example 6 satisfied the property values (B) which are a requisite in the present invention.

| | Example 5 | Example 6 | Comp. Example 7 | Comp. Example 8 |
|---|---|---|---|---|
| 1) Degree of crystallinity (%) | 25 | 25 | 28 | 29 |
| 2) Crystal size (nm) | | | | |
| Miller index (010) | 3.1 | 3.0 | 3.8 | 2.8 |
| Miller index (100) | 3.1 | 3.1 | 3.4 | 3.1 |
| Miller index (105) | 2.8 | 2.9 | 4.5 | 4.3 |
| crystal size difference between indices | 0.3 | 0.2 | 1.1 | 1.5 |
| 3) Degree of crystal orientation (%) | | | | |
| Miller index (010) | 78 | 79 | 88 | 87 |
| Miller index (105) | 40 | 48 | 88 | 87 |
| 4) Degree of amorphous orientation | 0.27 | 0.29 | 0.52 | 0.53 |
| 5) Amorphous density (g/cm$^3$) | 1.34 | 1.33 | 1.31 | 1.32 |
| 6) Amorphous density/deg. of amorphous orientation | 4.5 | 4.6 | 2.5 | 2.5 |
| 7) Initial elongation (%) | 18 | 17 | 8 | 7 |
| 8) Apparent Young's modulus | 41 | 40 | 450 | 437 |

Example 7, Comparative Example 9

A sportswear warm-up suit (structure: double jersey) was produced using the shrunk yarn of Example 3 as the back material, and using shrunk yarn (200 denier, 36 filament) obtained by processing 140 denier 36 filament POY by the same method, as the front ground structure and centre yarn. After heat-treating with dry heat for 3 minutes at 180° C., the impact resistance and pilling resistance were compared (Example 7). This product had superior impact resistance to Comparative Example 9 in which 150 denier 48 filament false-twist textured yarn was employed for the front ground structure, 150 denier 30 filament false-twist textured yarn as the centre yarn and 300 denier 96 filament false-twist textured yarn for the back ground structure. Moreover, pilling did not readily occur.

The results of analyses of yarn removed from the centre yarn therein were as follows.

| | Example 7 | Comparative Example 9 |
|---|---|---|
| 1) Degree of crystallinity (%) | 24 | 29 |
| 2) Crystal size (nm) | | |
| Miller index (010) | 3.5 | 4.1 |
| Miller index (100) | 3.4 | 3.6 |
| Miller index (105) | 3.0 | 4.7 |
| difference in crystal size between indices | 0.5 | 1.1 |
| 3) Degree of crystal orientation (%) | | |
| Miller index (010) | 64 | 88 |
| Miller index (105) | 43 | 89 |
| 4) Degree of amorphous orientation | 0.26 | 0.50 |
| 5) Amorphous density (g/cm$^3$) | 1.34 | 1.30 |
| 6) Amorphous density/deg. of amorphous orientation | 5.2 | 2.6 |
| 7) Initial elongation (%) | 18 | 7 |
| 8) Apparent Young's modulus | 43 | 440 |

Example 8

A plain weave fabric was woven of warp density 33 per inch and weft density 46 per inch, using 150 denier 48 filament false-twist textured yarn as the warp and, as the weft, a 100 T/M twisted (plied) yarn (S twist) comprising the shrunk yarn from Example 3 and 280 denier 14 filament drawn yarn.

This grey cloth was passed through a conveyor net type dry heater and treatment carried out for 2.5 minutes at 130° C. Next, treatment was performed for 2.5 minutes at 180° C. using the same dry heater and then dyeing carried out for 45 minutes at 130° C. The fabric obtained possessed warp/weft anisotropic resilience and, when employed as a suit breast lining, suit silhouette formation was easy, and there were many advantages compared to a conventional interlining in that many colours could be obtained, the shape was not readily destroyed by washing with water, and it was light in weight, etc. The analytical values for the yarn obtained by extracting the shrunk yarn from the lining were as follows.

| | Example 8 |
|---|---|
| 1) Degree of crystallinity (%) | 26 |
| 2) Crystal size (nm) | |
| Miller index (010) | 3.2 |
| Miller index (100) | 3.3 |
| Miller index (105) | 3.1 |
| difference in crystal size between Miller indices | 0.2 |

-continued

| | Example 8 |
|---|---|
| 3) Degree of crystal orientation (%) | |
| Miller index (010) | 77 |
| Miller index (105) | 46 |
| 4) Degree of amorphous orientation | 0.28 |
| 5) Amorphous density (g/cm$^3$) | 1.35 |
| 6) Amorphous density/degree of amorphous orientation | 4.8 |
| 7) Initial elongation (%) | 16 |
| 8) Apparent Young's modulus | 38 |

Comparative Example 10

255 denier 30 filament POY was obtained by the melt spinning of polyethylene terephthalate (IV=0.68) at a take-off rate of 3100 m/minute. This POY was used as it was to produce a plain weave fabric of warp density 56 per inch and weft density 55 per inch. When this woven material was passed through hot water at 95° C., there was considerable shrinkage (warp shrinkage 29% and weft shrinkage 32%), so an extremely harsh woven material with considerable wrinkling and surface unevenness was formed. The weave density at this time was 74 warp per inch and 71 weft per inch. This woven material was heat-treated for 7 minutes at 180° C. in a hot forced-air dryer. Next, it was dyed using disperse dye for 40 minutes at 130° C.

The fabric obtained had considerable rubber elasticity and when squeezed by hand and then released, it immediately sprung back to its original shape. However, the wrinkles and unevenness produced by the hot water treatment remained and it had low product value. The analytical values for yarn removed from this woven material were as follows.

| | Comparative Example 10 |
|---|---|
| 1) Degree of crystallinity (%) | 27 |
| 2) Crystal size (nm) | |
| Miller index (010) | 3.5 |
| Miller index (100) | 2.9 |
| Miller index (105) | 3.3 |
| difference in crystal size between indices | 0.6 |
| 3) Degree of crystal orientation (%) | |
| Miller index (010) | 78 |
| Miller index (105) | 41 |
| 4) Degree of amorphous orientation | 0.21 |
| 5) Amorphous density (g/cm$^3$) | 1.33 |
| 6) Amorphous density/degree of amorphous orientation | 6.3 |
| 7) Initial elongation (%) | 15 |
| 8) Apparent Young's modulus | 70 |

The results for the examples and comparative examples above are collected together in Table 1.

TABLE 1

| | Conditions in Claims | Example 1 | Example 2 | Example 3 | Example 4 | Example 5 | Example 6 | Example 7 | Example 8 |
|---|---|---|---|---|---|---|---|---|---|
| Processing Conditions for the Highly Oriented Undrawn Polyester Yarn | | | | | | | | | |
| heater temperature | | | | | | | | | |
| first (° C.) | ≧250° C. | 350 | 320 | 350 | | | | | |
| second (° C.) | ≧300° C. | — | 320 | 450 | | | | | |
| tension (× $10^{-2}$ g/d) | 0.3–5.0 | 1.5 | 1.8, 0.7 | 1.8, 0.7 | | | | | |
| processing rate (m/min) | ≧300 | 350 | 400 | 420 | | | | | |
| shrinkage total (%) | 5–40 | 25 | 30 | 30 | | | | | |

TABLE 1-continued

| | | | | | | | | | | |
|---|---|---|---|---|---|---|---|---|---|---|
| Properties (A) | | | | | | | | | | |
| specific gravity (g/cm$^3$) | | 1.335–1.360 | 1.341 for | 1.348 for | 1.346 for | same as as for | same as for | same as | back same | same as |
| degree of crystallinity (%) | | 21–26 | 22 | 23 | 23 | Example | Example | Example | Example 3 | Example |
| crystal size (nm) | 010 plane | 1.4–2.2 | 1.7 | 1.9 | 1.7 | 3 | 3 | 4 | front and | 3 |
| | 100 plane | 1.4–2.5 | 1.6 | 1.7 | 1.7 | | | | centre yarn: | |
| | 105 plane | 1.6–3.5 | 2.7 | 2.9 | 2.6 | | | | 140- | |
| degree of crystal orientation | | | | | | | | | 36POY | |
| (%) | 010 plane | ≦75 | 53 | 51 | 55 | | | | shrunk yarn | |
| | 105 | ≦85 | 72 | 78 | 73 | | | | | |
| degree of amorphous orientation (%) | | 0.15–0.4 | 0.22 | 0.20 | 0.20 | | | | | |
| dry shrinkage/hot water shrinkage (%) | | 0–35 | 6.8 | 5.6 | 5.6 | | | | | |
| Heat Treatment Conditions | | | | | | | | | | |
| heat treatment temp × time (° C. × min) | | ≧120 | 180 × 3 | 180 × 3 | 180 × 3 | 180 × 5 | 180 × 1 | 180 × 1 | 180 × 3 | 130 × 2.5 + 180 × 2.5 |
| Properties (B) | | | | | | | | | | |
| degree of crystallinity (%) | | 22–30 | 23 | 24 | 24 | 24 | 25 | 25 | 24 | 26 |
| crystal size (nm) | 010 plane | 2.5–4.5 | 3.1 | 3.5 | 3.7 | 3.3 | 3.1 | 3.0 | 3.5 | 3.2 |
| | 100 plane | 2.5–4.5 | 3.5 | 3.4 | 3.4 | 3.4 | 3.1 | 3.1 | 3.4 | 3.3 |
| | 105 plane | 2.0–4.5 | 3.2 | 2.8 | 3.0 | 3.2 | 2.8 | 2.9 | 3.0 | 3.1 |
| difference in crystal size between Miller indices | | ≦1.0 | 0.4 | 0.7 | 0.7 | 0.2 | 0.3 | 0.2 | 0.5 | 0.2 |
| degree of crystal orientation | 010 plane | 50–85 | 75 | 63 | 63 | 75 | 78 | 79 | 64 | 77 |
| | 105 plane | 30–80 | 68 | 41 | 41 | 55 | 40 | 48 | 43 | 46 |
| Degree of amorphous orientation (%) | | 0.15–0.4 | 0.26 | 0.26 | 0.26 | 0.29 | 0.27 | 0.29 | 0.26 | 0.28 |
| amorphous density (g/cm$^3$) | | 1.31–1.37 | 1.35 | 1.35 | 1.35 | 1.33 | 1.34 | 1.33 | 1.34 | 1.35 |
| amorphous density/degree of orientation | | ≧3.2 | 5.2 | 5.2 | 5.2 | 4.6 | 4.5 | 4.6 | 5.2 | 4.8 |
| initial elongation (%) | | ≧10 | 18 | 22 | 20 | 17 | 18 | 17 | 18 | 16 |
| apparent Young's modulus (kgf/mm$^2$) | | ≧140 | 41 | 32 | 36 | 40 | 41 | 40 | 43 | 38 |

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 1 | Comp. Ex. 10 |
|---|---|---|---|---|---|---|---|---|---|---|---|
| Processing Conditions for the Highly Oriented Undrawn Polyester Yarn | | | | | | | | | | | |
| heater temperature | | | | | | 280-14 | 300-72 | | | front | POY |
| first (° C.) | | room temp. | 280 | 350 | 180 | drawn | false twist | | | 150-48 | woven |
| second (° C.) | | | | — | — | yarn | textured | | | centre | fabric |
| tension (× 10$^{-2}$ g/d) | | | | ≦1 | ≦1.5 | used as | yarn used | | | 150-30 | |
| processing rate (m/min) | | | | 400 | 400 | the | as the | | | back | |
| shrinkage total (%) | | | | 50 | 20 | centre | centre | | | 300-96 | |
| | | | | | | yarn | yarn | | | false | |
| | | | | | | | | | | twist | |
| | | | | | | | | | | yarn | |
| | | | | | | | | | | used | |
| Properties (A) | | | | | | | | | | | |
| specific gravity (g/cm$^3$) | | 1.355 | 1.362 | 1.350 | 1.341 | 1.355 | 1.362 | same as | same as | | 1.339 |
| degree of crystallinity (%) | | 25 | 27 | 18 | 17 | 28 | 29 | for | for | | 25 |
| crystal size (nm) | 010 plane | 2.1 | 2.3 | 1.8 | 1.4 | 2.4 | 2.2 | Comp. | Comp. | | 1.4 |
| | 100 plane | 2.2 | 2.3 | 1.6 | 1.4 | 2.5 | 2.5 | Example | Example | | 1.4 |
| | 105 plane | 3.7 | 4.1 | 1.4 | 1.6 | 4.1 | 4.1 | 5 | 6 | | 1.6 |
| degree of crystal orientation | | | | | | | | | | | |
| (%) | 010 plane | 83 | 87 | 53 | 60 | 88 | 86 | | | | 62 |
| | 105 | 83 | 87 | 71 | 65 | 87 | 87 | | | | 68 |
| degree of amorphous orientation (%) | | 0.51 | 0.55 | 0.11 | 0.24 | 0.55 | 0.55 | | | | 0.24 |
| dry shrinkage/hot water shrinkage (%) | | 11, 13 | 9, 10 | 13, 15 | ≧40 | 5, 6 | 9, 10 | | | | ≧50 |
| Heat Treatment Conditions | | | | | | | | | | | |
| heat treatment temp × time (° C. × min) | | 180 × 3 | 180 × 3 | 180 × 3 | 180 × 3 | 180 × 5 | 180 × 5 | 180 × 1 | 180 × 1 | 180 × 3 | 180 × 7 |
| Properties (B) | | | | | | | | | | | |
| degree of crystallinity (%) | | 26 | 28 | 19 | 17 | 28 | 29 | 28 | 29 | 29 | 27 |
| crystal size (nm) | 010 plane | 4.0 | 4.3 | 3.3 | 2.4 | 4.3 | 4.1 | 3.8 | 2.8 | 4.1 | 3.5 |
| | 100 plane | 3.3 | 3.6 | 2.8 | 2.8 | 3.7 | 3.6 | 3.4 | 3.1 | 3.6 | 2.9 |
| | 105 plane | 4.6 | 4.8 | 2.5 | 2.4 | 4.9 | 4.7 | 4.5 | 4.3 | 4.7 | 3.3 |
| difference in crystal size between Miller indices | | 1.3 | 1.2 | 0.8 | 0.4 | 1.2 | 1.1 | 1.1 | 1.5 | 1.1 | 0.6 |
| degree of crystal orientation | 010 plane | 86 | 90 | 59 | 58 | 90 | 89 | 88 | 87 | 88 | 78 |
| | 105 plane | 86 | 90 | 75 | 76 | 89 | 88 | 88 | 87 | 89 | 41 |
| Degree of amorphous orientation (%) | | 0.50 | 0.52 | 0.12 | 0.13 | 0.51 | 0.50 | 0.52 | 0.53 | 0.50 | 0.21 |
| amorphous density (g/cm$^3$) | | 1.31 | 1.31 | 1.34 | 1.35 | 1.30 | 1.30 | 1.31 | 1.32 | 1.30 | 1.33 |
| amorphous density/degree of orientation | | 2.6 | 2.5 | 11.2 | 10.4 | 2.5 | 2.6 | 2.5 | 2.5 | 2.6 | 6.3 |

TABLE 1-continued

| | | | | | | | | | | |
|---|---|---|---|---|---|---|---|---|---|---|
| initial elongation (%) | 7 | 8 | 48 | 56 | 8 | 7 | 8 | 7 | 7 | 15 |
| apparent Young's modulus (kgf/mm$^2$) | 380 | 460 | * | * | 453 | 432 | 450 | 437 | 440 | 70 |

*Measurement impossible

Industrial Field of Application i) The polyester fibre of the present invention can provide fibre and fabrics which are outstanding in their resilience and the like.

ii) Fabric obtained from the polyester fibre of the present invention can possess outstanding resistance to permanent yielding (resistance to pile damage, pile tilting, etc), and outstanding bulkiness and cushioning properties. In particular, remarkable effects are obtained in the multilayer fabrics known as spatial fabrics such as knitted spacer fabrics.

iii) Fabric obtained from the polyester fibre of the present invention possesses the aforesaid characteristics to a high degree, so there is no need to compensate for inadequate performance by providing a layer of polyurethane foam as in conventional materials, and therefore there is a considerable cost advantage and, since a structure comprising only polyester fibre is possible, this is environmentally beneficial.

iv) In the case where used as the centre yarn (splicing yarn or pillar yarn) of a spatial fabric such as a knitted spacer fabric, performance is good even without employing fusion bonding fibre or false-twist textured yarn as in conventional products, and since the yarn itself is of low price and processing is simple, production can be carried out cheaply.

v) Fibre obtained from the polyester fibre of the present invention and fabric thereof do not readily exhibit stress concentrations in that they posses rubber elasticity, so it is possible to obtain fabrics of high tear strength, impact absorption properties and resistance to pilling.

What is claimed is:

1. A method for producing intermediate yam comprising polyester fibers having the following properties (A):

(1) Specific gravity 1.335–1.360, (2) Degree of crystallinity 21–26%, (3) Crystal size in terms of Miller index (010) 1.4–2.2 nm, in terms of Miller index (100) 1.4–2.5 nm and in terms of Miller index (105) 1.6–3.5, (4) Degree of crystal orientation no more than 75% in the 010 plane and no more than 85% in the 105 plane, and (5) Degree of amorphous orientation 0.15–0.4, hot water shrinkage 0 to 35% and dry heat shrinkage 0–35%, which is characterized in that highly oriented undrawn polyester yarn, obtained by melt-spinning at a take-off speed of 2500–3500 m/min, having a birefringance of 20–80×10$^{-3}$ is passed under a tension of 0.3×10$^{-2}$ g/d to 5.0×10$^{-2}$ g/d through a non-contact heater at a heater temperature of at least 250° C., and wherein 5 to 40% shrinkage is effected.

2. A method for producing intermediate yarn according to claim 1 which is characterized in that the shrinkage is effected in a plurality of stages using a non-contact heater having at least two heating zones with controlled temperatures.

3. A method for producing intermediate yarn as defined in claim 1, wherein the passing speed is at least 300 minute.

* * * * *

UNITED STATES PATENT AND TRADEMARK OFFICE

CERTIFICATE OF CORRECTION

PATENT NO. : 6,623,681 B1
DATED : September 23, 2003
INVENTOR(S) : Taguchi et al.

It is certified that error appears in the above-identified patent and that said Letters Patent is hereby corrected as shown below:

Column 4,
Line 37, please delete “30” before “time”.

Column 13,
Line 44, please change “10-2” to -- $10^{-2}$ --; and
Line 45, please delete “20” before “450° C.”.

Column 19,
Table 1-continued, at “specific gravity ($g/cm^3$)”
Examples 1, 2 and 3, please delete the word “for”;
Example 6, please insert -- for -- after “same as”;
Example 7, please insert -- as for --, after “back same”; and
Example 8, please insert -- for -- after “same as”.

Signed and Sealed this

Ninth Day of March, 2004

JON W. DUDAS
*Acting Director of the United States Patent and Trademark Office*